US006202865B1

(12) United States Patent
Kuo

(10) Patent No.: US 6,202,865 B1
(45) Date of Patent: Mar. 20, 2001

(54) SAMPLE AND TOOL DISPLAYING BOARD

(76) Inventor: Li-Jen Kuo, P.O. Box 82-144, Taipei (TW)

( * ) Notice: Subject to any disclaimer, the term of this patent is extended or adjusted under 35 U.S.C. 154(b) by 0 days.

(21) Appl. No.: 09/323,005

(22) Filed: Jun. 1, 1999

(51) Int. Cl.[7] ..... A47F 7/00
(52) U.S. Cl. ..... 211/70.6
(58) Field of Search ..... 211/70.6, 60.1, 211/13.1, 85.26

(56) References Cited

U.S. PATENT DOCUMENTS 4,631,783 * 12/1986 Hayashi ..... 211/70.6
4,634,005 * 1/1987 Kulzer et al. ..... 211/70.6
5,044,591 * 9/1991 Huang ..... 211/70.6
5,082,111 * 1/1992 Corbitt, Jr. et al. ..... 211/70.6
5,762,211 * 6/1998 Ensign ..... 211/70.6
5,816,401 * 10/1998 Vasudeva et al. ..... 211/70.6
5,906,350 * 5/1999 Kao ..... 211/70.6
5,967,340 * 10/1999 Kao ..... 211/70.6
5,988,381 * 11/1999 Ling ..... 211/70.6
5,996,817 * 12/1999 Kao ..... 211/70.6

* cited by examiner

*Primary Examiner*—Alvin Chin-Shue
*Assistant Examiner*—Sarah Purol
(74) *Attorney, Agent, or Firm*—A & J

(57) ABSTRACT

A sample and tool displaying board is disclosed, and comprises (a) a board body having a plurality of engaging slots thereon; (b) a plurality of fastening clips, having a top clipping member and a pair of engaging posts, having a spherical body at the top end thereof, being mounted at the bottom thereof, and said fastening clips being mounted onto said board body; (c) a securing strap being formed between two fastening clips and being secured by the clipping member, and said engaging posts being mounted within said engaging slots, thereby a sample or a tool is secured onto the displaying board by said securing strap. The engaging slot has a round hole at one end of the slot, and an elongated slot extension from one end to the round hole such that the engaging posts can be inserted into the engaging slots and secured thereon. The present displaying board provides easy and convenient displaying for samples and tools, or arrangement of the displayed samples and tools.

1 Claim, 7 Drawing Sheets

SAMPLE AND TOOL DISPLAYING BOARD

BACKGROUND OF THE INVENTION (a) Field of the Invention

The present invention relates to a sample and tool displaying board, wherein a sample or tools of different sizes can be adjustably mounted on the displaying board.

(b) Description of the Prior Art

FIG. 8 shows a conventional displaying board comprising a board body 2 mounted with a suspension hole 20, an indication area 21 and a display area 22, wherein the indication area 21 is adapted for placing a sample data description label, and within the display area 22, a plurality of pores 23 are provided for a mounting strap 3. The strap 3 is a rope-like member has one end being provided with an insertion hole 30, and a plurality of engaging teeth 31 are provided within the insertion hole 30. The other end of the mounting strap 3 is provided with a plurality of protruded teeth 32.

When a sample 1 is to be mounted on the displaying board, the mounting strap 3 surrounds the external surface of the sample 1 and the two ends of the mounting strap 3 pass through the pores 23 adjacent to the board body 2. Then, one end of the mounting strap 3 having the protruded teeth 30 goes into the insertion hole 30 and then pull the mounting strap 3 at both ends thereof until the sample 1 is firmly secured to the board body 2. The protruded teeth 32 are in engagement with the engaging teeth 31 with the protruded teeth 30.

In view of the above, the conventional displaying board has drawbacks as follows when in use:

1) Re-use of mounting strap is not possible

After the sample 1 is secured by the mounting strap 3, the strap cannot be untied and re-used. Thus, if the sample 1 is to be replaced, the mounting strap 3 has to be cut and a new mounting strap 3 has to be used. Thus, cost is involved in replacing the mounting strap 3.

2) Inconvenient to replace the sample.

The only way to replace the sample 1 is to cut off the mounting strap 3. As a result, only those samples which are not to be taken down are displayed, and the displaying board is not convenient to display sample 1 which needs to be replaced often.

Another type of conventional displaying board to overcome the above drawbacks has been designed. As shown in FIG. 9, the displaying device comprises a board body 4 having a plurality of hanging hooks 5, wherein a plurality of shallow grooves 40 are provided on the board body 4 and a plurality of apertures 41 are provided within the grooves 40. The hanging hook 5 can be inserted into the apertures 41 at one end and the other end of the hanging hook 5 is protruded out of the board body 4.

Thus, the sample 1 or tool 10 can be placed on the hanging hook 5. However, this conventional displaying board has the following drawbacks:

1) Only a handful of suspension tool or sample can be displayed.

If sample 1 or tool 10 does not have a hole at one end thereof, the sample 1 or the tool 10 cannot be inserted into the hanging hook 5. Thus, these sample 1 and tool 10 cannot be displayed on this conventional display board.

2) Displayed samples may easily drop off from the board. As the displayed sample 1 or tool 10 is not firmly secured to the board body 4, the hanged sample may be dropped off if it is accidentally touched.

SUMMARY OF THE INVENTION

Therefore, it is an object of the present invention to provide a sample and tool displaying board, which can overcome the above drawbacks.

One aspect of the present invention is to provide a sample and tool displaying board comprising (a) a board body having a plurality of engaging slots thereon;(b) a plurality of fastening clips, having a top clipping member and a pair of engaging posts having a spherical body at the top end thereof, and being mounted at the bottom thereof, and said fastening clips being mounted onto said board body; (c) a securing strap being formed between two fastening clips and being secured by the clipping member, and said engaging posts being mounted within said engaging slots, thereby a sample or a tool is secured onto the displaying board by said securing strap.

DETAILED DESCRIPTION OF THE PREFERRED EMBODIMENT

Figure 1:
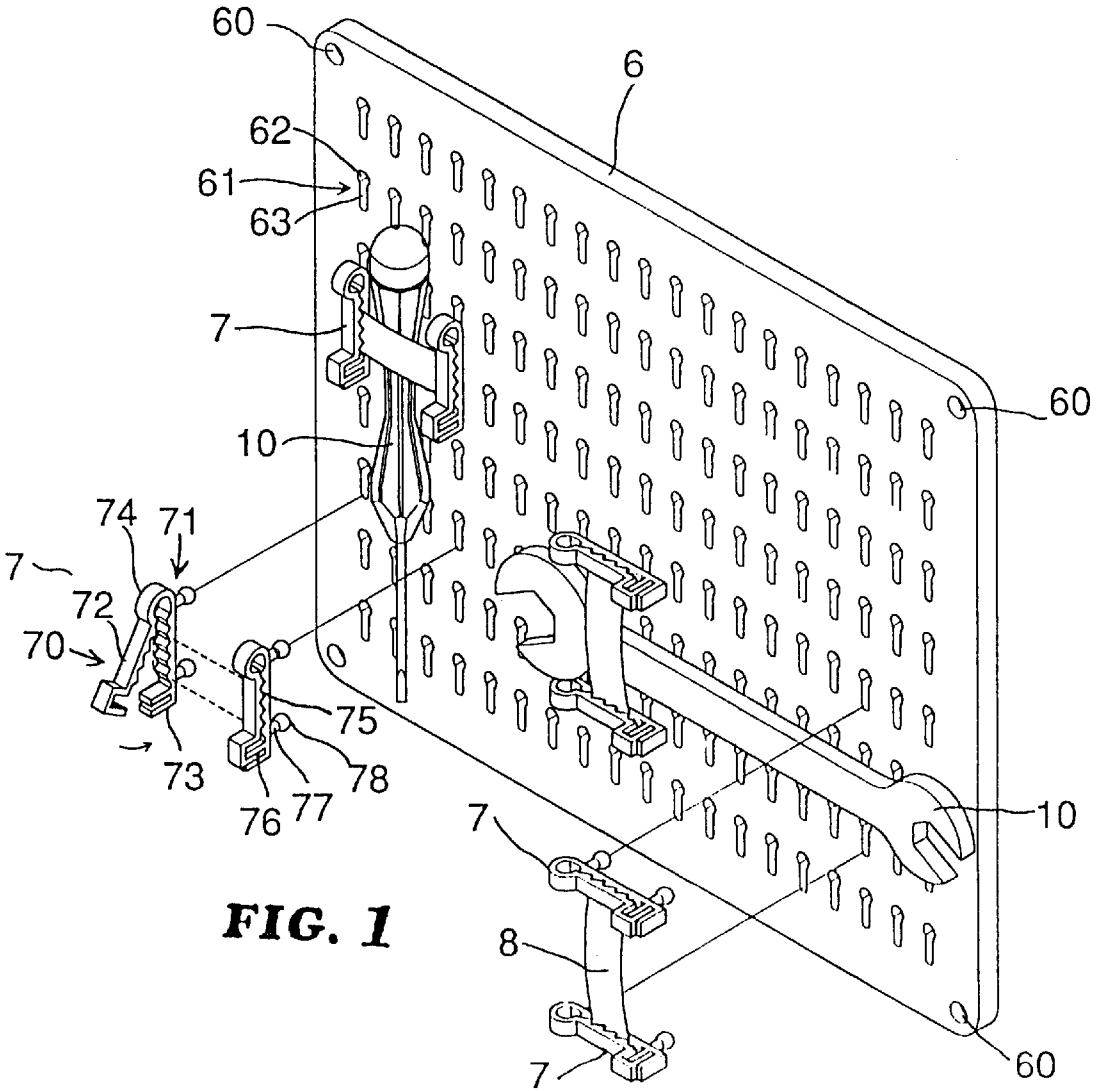
FIG. 1 is a perspective exploded view of the sample and tool displaying board in accordance with the present invention.

Reference will now be made in detail to the preferred embodiment of the present invention, example of which is illustrated in the accompanying drawings:

Referring to FIG. 1, the sample and tool displaying board comprises a board comprises of the present invention a board body 6, a plurality of fastening clips 7, and a securing strap 8. In accordance with the preferred embodiment, the board body 6 is provided with four securing holes 60, each at one corner of the board body 6, for mounting the board body 6 onto a wall. A plurality of engaging slots 61 are provided on the surface of the board body 6 and are arranged at an appropriate equal interval. The engaging slots 61 has a round hole 62 at one end and an elongated slot 63 extended from the round hole 62 to the other end of the engaging slot 61. In accordance with the present invention, the round hole 62 has a larger diameter than the width of the elongated slot 63. On the other surface of the board body 6, corresponding to the engaging slots 61, a plurality of horizontal grooves 64 (refer to FIG. 2) are formed.

The fastening clip 7 includes a top clipping member 70 and a fastening seat 73, and the fastening clip 7 is used to clip the securing strap 8. The bottom face of the fastening seat 73 is provided with a pair of engaging posts 71, and the clipping member 70 is provided with a clipping disc 72 having one end connected to an arc-shaped flexible connector 74, which connects the clipping disc 72 to the fastening seat 73. The top face of the fastening seat 73 and the inner face of the clipping disc 72 are provided with a plurality of clipping teeth 75, 76 to firmly clip the securing strap 8. The clipping teeth 75, 76 are mutually engaged with each other when the clipping disc 72 is engaged with the fastening seat 73. The engaging posts 71 are a protruded element 77 having a spherical body 78 at the top end thereof to be inserted into the round hole 62 and the elongated slot 63. In accordance with the present invention, the distance between the two engaging posts 71 approximately equals to the distance between two engaging slots 61 or a multiple of the distance between two engaging slots 61.

In accordance with the present invention, the securing strap 8 is an elastic strap which can be mounted and secured to the fastening clip 7, and a sample 1 or a tool 10 is secured to the board body 6 by means of the securing strap 8.

Figure 2:
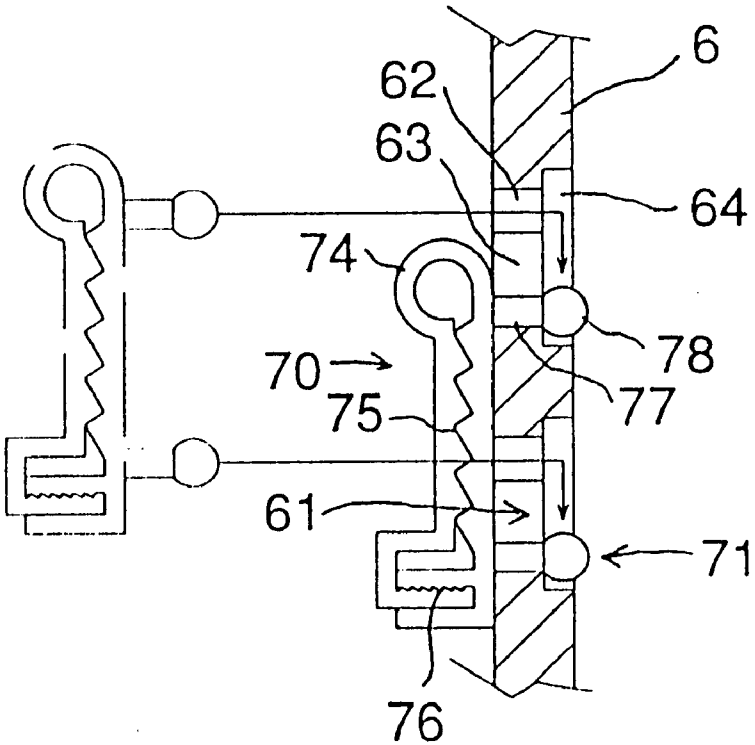
FIG. 2 is a schematic view illustrating the mounting of the fastening clip vertically in accordance with the present invention.

Referring to FIGS. 1 and 2, when the sample 1 or the tool 10 is to be mounted vertically on the board body 6, an appropriate length of securing strap 8 is mounted in between two fastening clips 7, and the clips 7 are mounted vertically on the board body 6 such that the spherical body 78 of the engaging post 71 is inserted into the round hole 62 of the engaging slot 61 and then the spherical body 78 is slided downward to the elongated slot 63. Thus, the elasticity of the securing strap 8 can secure the sample 1 or the tool 10 vertically on the board body 6. Any label to be made to the sample 1 or the tool 10 can be placed beside the space beside the sample 1 or tool 10.

Figure 3:
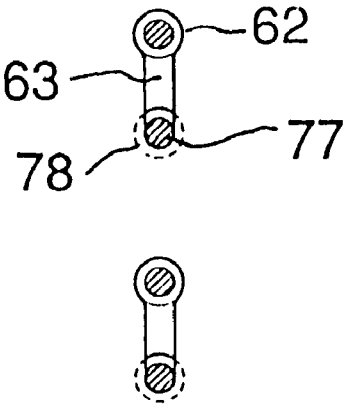
FIG. 3 is a schematic view illustrating the mounting of the fastening clip with the engaging post vertically in accordance with the present invention.
Figure 4:
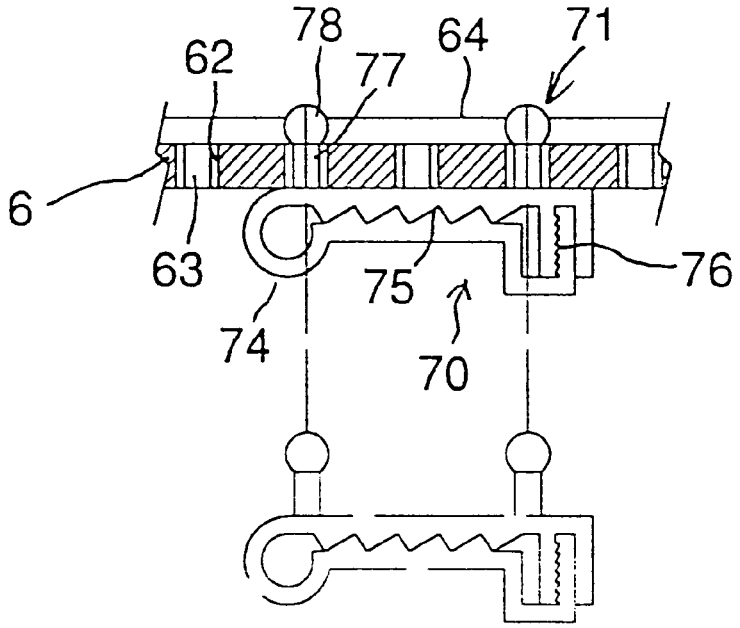
FIG. 4 is a schematic view illustrating the mounting of the fastening clip horizontally in accordance with the present invention.
Figure 5:
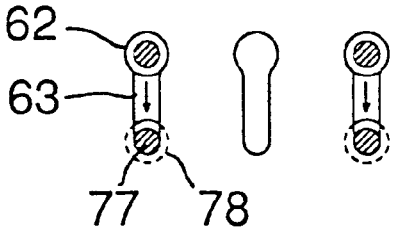
FIG. 5 is a schematic view illustrating the movement of the engaging post when the fastening clip is mounted horizontally in accordance with the present invention.

In accordance with the present invention, and referring FIGS. 3, 4 and 5, when the sample 1 or the tool 10 is to be placed horizontally on the board body 6, an appropriate length of the securing strap 8 is mounted in between two fastening clips 7. The two fastening clips 7 are mounted in horizontal on the board body 6 and the spherical body 78 of the engaging posts 71 are inserted into the round hole 62 of the engaging slot 61 and then the spherical body 78 is slided downward to the elongated slot 63. Thus, the securing strap 8 secures the sample 1 or tool 10 onto the board body 6.

Figure 6:
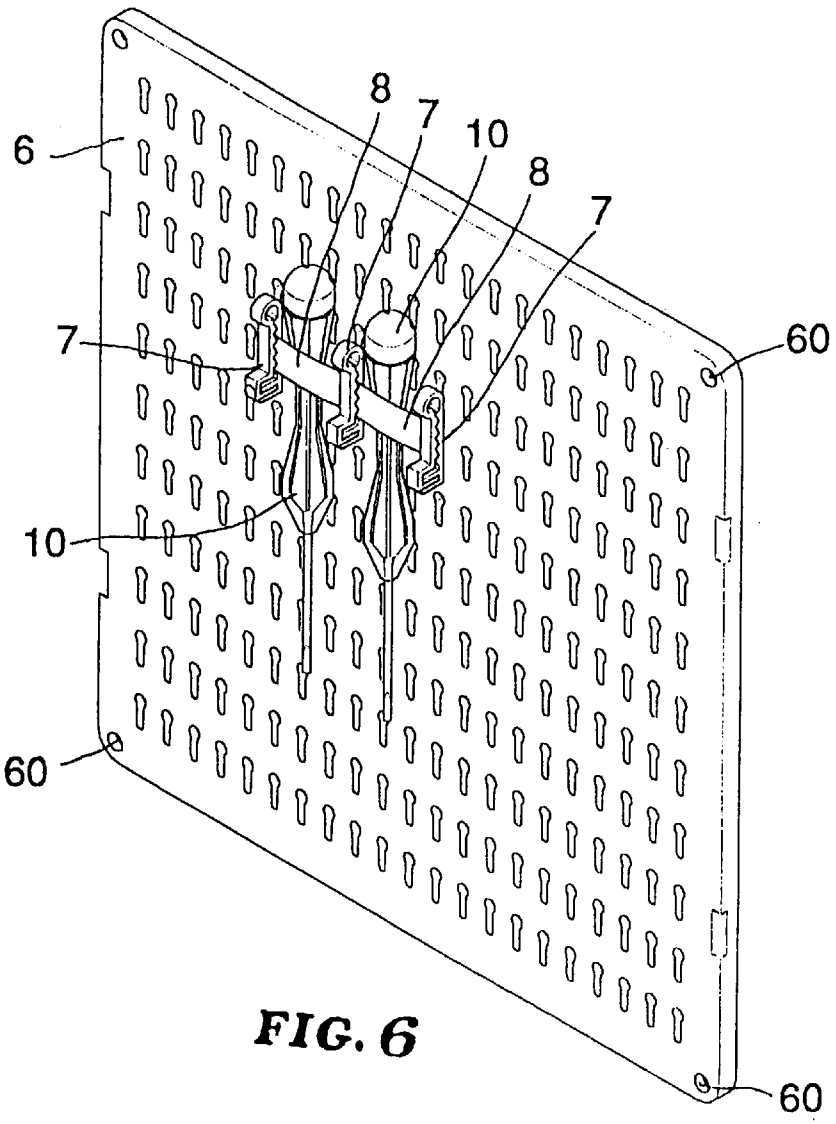
FIG. 6 is a perspective view illustrating a further preferred embodiment in accordance with the present invention.

As shown in FIG. 6, the fastening clips 7 can be arranged at a short distance next to each other on the board body 6 to increase another space for the mounting of a sample 1 or a tool 10 to save the use of an extra fastening clip 7.

Figure 7:
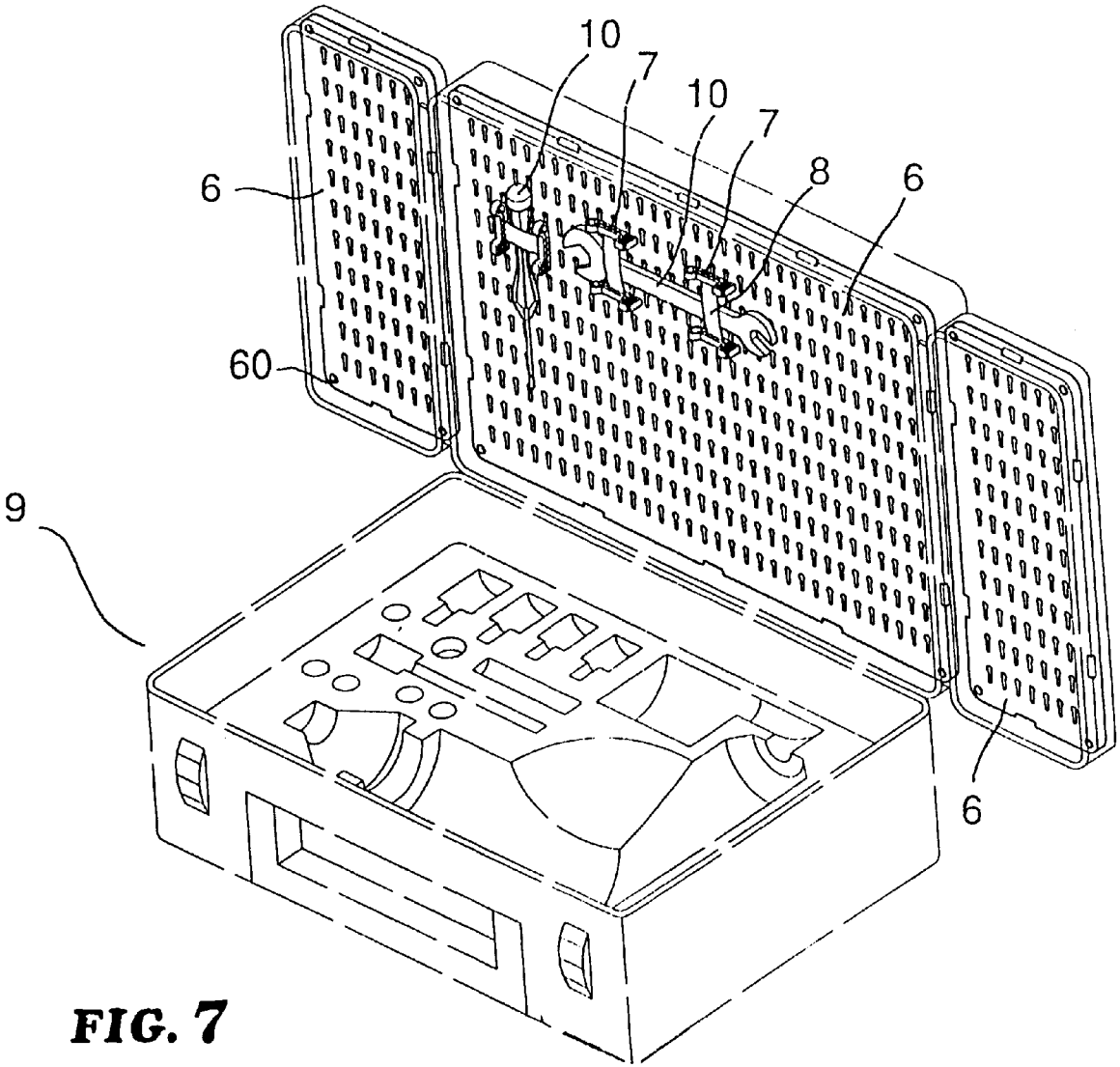
FIG. 7 is a perspective view illustrating another preferred embodiment in accordance with the present invention.
Figure 8:
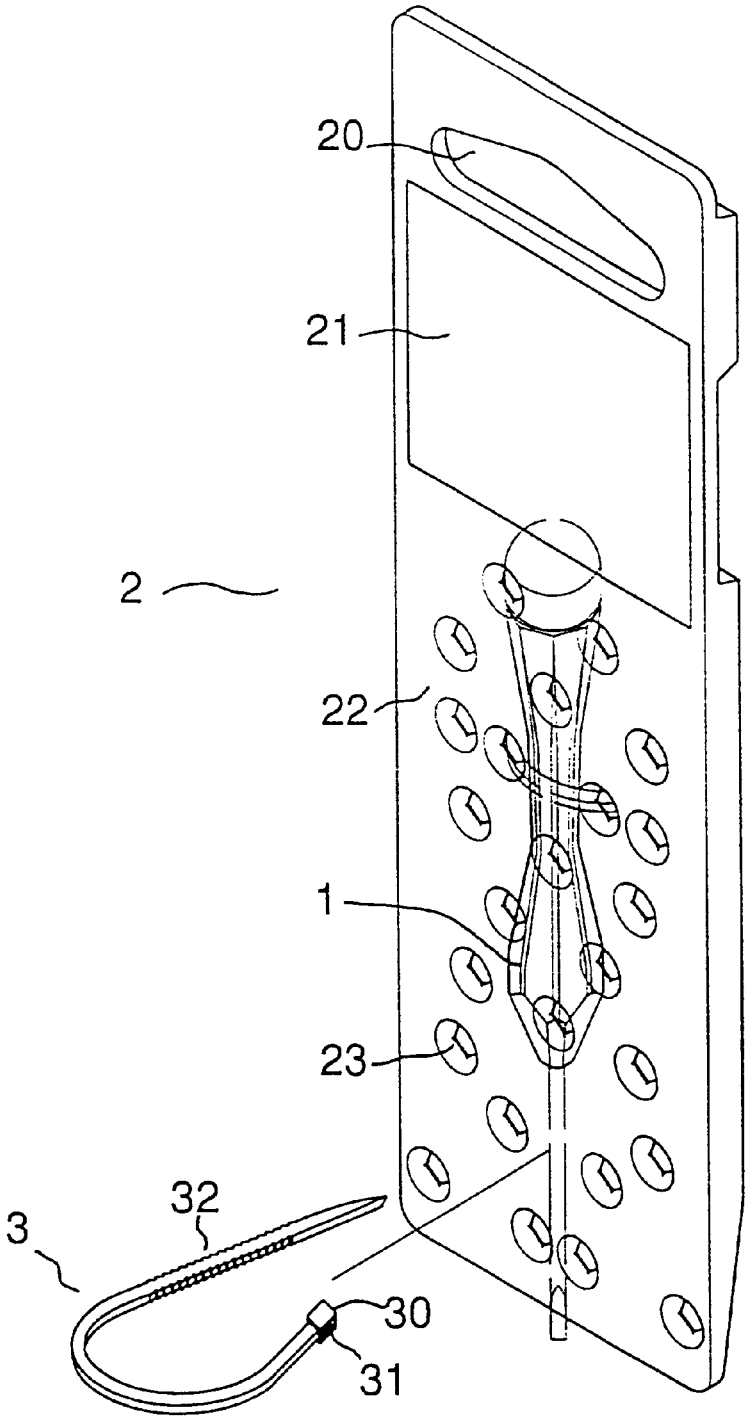
PRIOR ART FIG. 8
FIG. 8 is a perspective view of a conventional sample displaying board.
Figure 9:
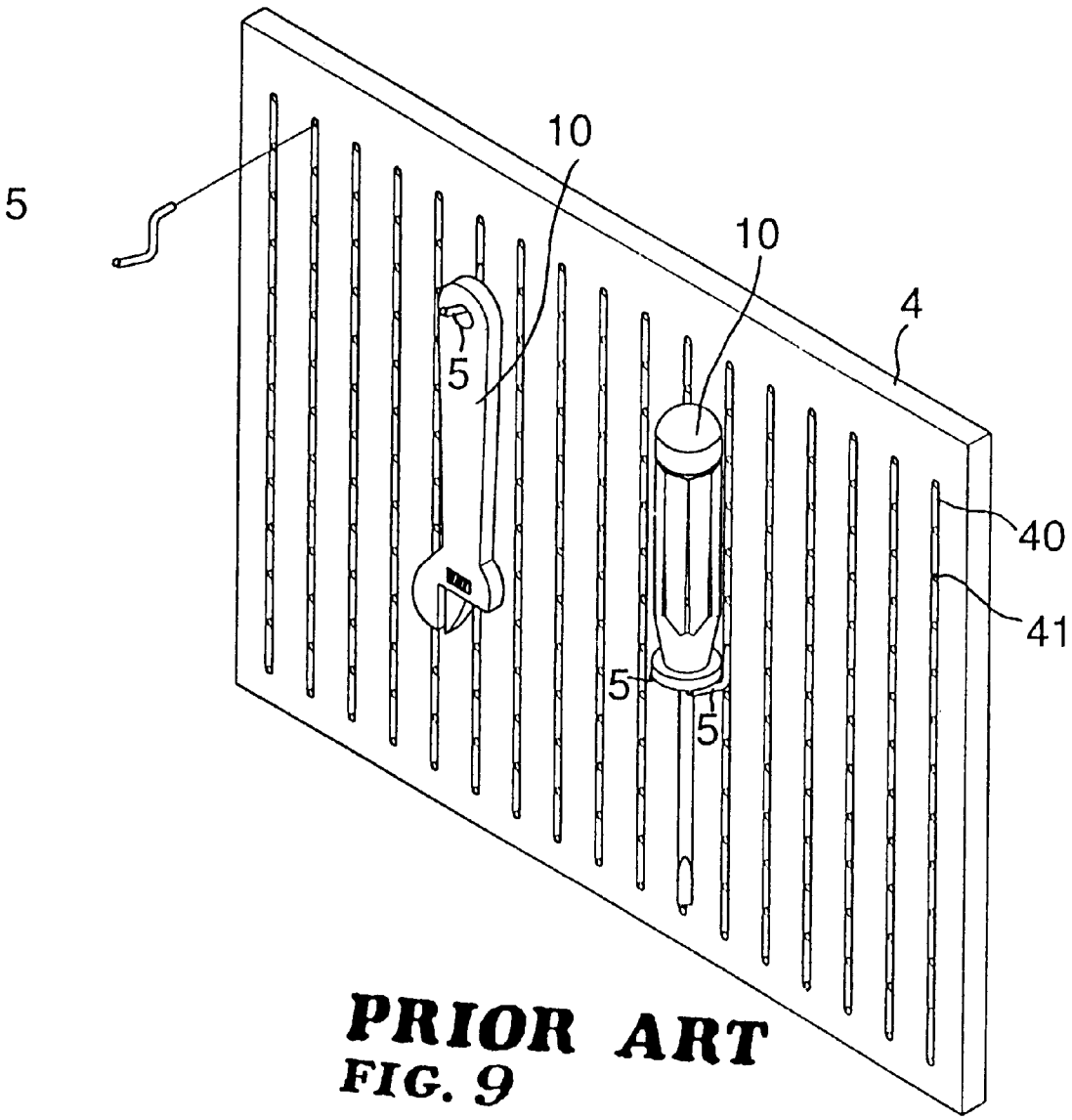
PRIOR ART FIG. 9
FIG. 9 is a perspective view of a conventional sample and tool displaying board.

Referring to FIG. 7, the board body 6 can be mounted onto a tool box 9 by the use of the securing hole 60 so as to hold a plurality of tools, etc.

In accordance with the present invention, the invention provides the following advantages:

1. Easy replacement of the fastening clip.

As the fastening clip 7 can be easily taken down from the board body 6 by dislocating the spherical body 78 of the engaging post 71 from the engaging slot 61, the replacement or installation of the clips 7 is easy and convenient.

2. Sample or tool can be easily taken down or replaced.

As the securing strap 8 is elastic, if it is pulled outward, the sample 1 or the tool 10 can be easily and conveniently taken down or replaced.

3. Provide mounting for various type of tools or sample.

As the board body 6 is provided with a plurality of fastening clips 7 and the strap 8 is elastic, various type and shapes of tools or samples can be mounted or displayed on the board body 6.

4. Firmly secured without falling.

As the sample or tool is secured by the securing strap 8 and the securing strap 8 is mounted by the fastening clips 7 disposed to the board body 6, the sample or the tools thus mounted will not fall from the board body 6 even the samples or the tools are knocked.

While this invention has been particularly shown and described with references to a preferred embodiment, it will be understood by those skilled in the art that various changes in form and details may be made therein without departing from the spirit and scope of the invention as defined by the appended claims.

What is claimed is:

1. A sample and tool displaying board comprising:

(a) a board body having a plurality of engaging slots thereon;

(b) a plurality of fastening clips, the clip consisting of a top clipping member and a bottom fastening seat having a pair of engaging post with a spherical body at the top end thereof, being mounted at the bottom thereof, and said fastening clips being detachably mounted onto said board body;

(c) a securing strap being formed between two fastening clips and being secured by the clipping member, and said engaging posts being detachably mounted within said engaging slots, thereby a sample or a tool is secured onto the displaying board by said securing strap;

wherein the engaging slot has a round hole at one end of the slot, and an elongated slot extension from one end to the round hole, the round hole has a diameter larger than the width of the elongated slot, the fastening clip includes a clipping member with a clipping disc and a fastening seat, said clipping disc and said fastening seat being joined by an arc-shaped connector, and a plurality of clipping teeth are provided on the top face of the fastening seat and the inner face of the clipping disc, such that the clipping teeth are engaged with each other when the clipping disc is clipped together with the fastening seat, the distance between two engaging posts equals to the distance between two engaging slots or a multiple of the distance between the engaging slots, the securing strap is an elastic strap.

* * * * *